US009123329B2

(12) United States Patent
Miao et al.

(10) Patent No.: US 9,123,329 B2
(45) Date of Patent: Sep. 1, 2015

(54) METHOD AND APPARATUS FOR GENERATING SIDEBAND RESIDUAL SIGNAL

(71) Applicant: Huawei Technologies Co., Ltd., Shenzhen, Guangdong (CN)

(72) Inventors: Lei Miao, Beijing (CN); Chen Hu, Shenzhen (CN); Wenhai Wu, Beijing (CN); Yue Lang, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 331 days.

(21) Appl. No.: 13/708,611

(22) Filed: Dec. 7, 2012

(65) Prior Publication Data

US 2013/0094655 A1 Apr. 18, 2013

Related U.S. Application Data

(63) Continuation of application No. PCT/CN2011/075014, filed on May 31, 2011.

(30) Foreign Application Priority Data

Jun. 10, 2010 (CN) ..... 2010 1 0200923

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... G10L 19/008; G10L 19/06; G10L 25/18; H04S 5/00; H04S 3/008; H04S 2420/03
USPC ..... 381/17–23, 27; 704/501
See application file for complete search history.

(56) References Cited

U.S. PATENT DOCUMENTS

2003/0012393 A1 1/2003 Armstrong
2003/0093266 A1 5/2003 Banba
(Continued)

FOREIGN PATENT DOCUMENTS

CN 1419349 A 5/2003
CN 101572088 A 11/2009
(Continued)

OTHER PUBLICATIONS

Communication from a foreign counterpart application, International Application No. PCT/CN2011/075014, International Search Report dated Sep. 8, 2011, 4 pages.
(Continued)

*Primary Examiner* — Alexander Jamal
(74) *Attorney, Agent, or Firm* — Conley Rose, P.C.; Grant Rodolph; Nicholas K. Beaulieu

(57) ABSTRACT

Embodiments of the present invention provide a method and an apparatus for generating a sideband residual signal. The method includes: comparing energy of a first signal input by a first sound channel with energy of a second signal input by a second sound channel; if the energy of the first signal is greater than the energy of the second signal, generating a sideband residual signal by allocating a monophonic quantization error to the first signal; and if the energy of the first signal is smaller than the energy of the second signal, generating a sideband residual signal by allocating a monophonic quantization error to the second signal. By using the method and apparatus provided in the embodiments of the present invention, it can be avoided that a monophonic quantization error has a greater impact on a signal whose energy is smaller.

17 Claims, 7 Drawing Sheets

(56) References Cited

U.S. PATENT DOCUMENTS

| | | | | |
|---|---|---|---|---|
| 2009/0150162 | A1* | 6/2009 | Goto et al. | 704/500 |
| 2009/0203344 | A1 | 8/2009 | Hanawalt et al. | |
| 2010/0322429 | A1 | 12/2010 | Norvell et al. | |
| 2011/0224994 | A1* | 9/2011 | Norvell et al. | 704/500 |

FOREIGN PATENT DOCUMENTS

| | | | |
|---|---|---|---|
| CN | 101604524 | A | 12/2009 |
| CN | 101635145 | A | 1/2010 |
| CN | 101673549 | A | 3/2010 |
| EP | 1251355 | A2 | 10/2002 |
| WO | 2009038512 | A1 | 3/2009 |
| WO | 2010009659 | A1 | 1/2010 |
| WO | 2010042024 | A1 | 4/2010 |

OTHER PUBLICATIONS

Communication from a foreign counterpart application, International Application No. PCT/CN2011/075014, English Translation, International Search Report dated Sep. 8, 2011, 4 pages.

Foreign Communication From a Counterpart Application, Chinese Application 2010102009233, Chinese Search Report dated Mar. 27, 2012, 2 pages.

* cited by examiner

METHOD AND APPARATUS FOR GENERATING SIDEBAND RESIDUAL SIGNAL

CROSS-REFERENCE TO RELATED APPLICATIONS

This application is a continuation of International Application No. PCT/CN2011/075014, filed on May 31, 2011, which claims priority to Chinese Patent Application No. 201010200923.3, filed on Jun. 10, 2010, both of which are hereby incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

Embodiments of the present invention relate to communications technologies, and in particular, to a method and an apparatus for generating a sideband residual signal.

BACKGROUND

A method for generating a stereophonic residual in the prior art includes: downmixing a signal input by a first sound channel with a signal input by a second sound channel to obtain a monophonic signal and a sideband signal; encoding the monophonic signal by using a monophonic encoding method; decoding the encoded signal to obtain a local decoded signal of the monophonic signal; extracting a stereophonic parameter from the signal input by the first sound channel and the signal input by the second sound channel, where the stereophonic parameter reflects a ratio of energy of the first sound channel to energy of the second sound channel; generating a sideband predication signal by using the local decoded signal and the stereophonic parameter; generating a sideband residual signal according to the sideband signal and the sideband predication signal; and then encoding the monophonic signal and the sideband residual signal.

In the method for generating a sideband residual signal in the prior art, the signal input by the first sound channel and the signal input by the second sound channel, which may be obtained by decoding at a decoding end, are related to the local decoded signal and the sideband residual signal. However, the local decoded signal and the sideband residual signal are encoded signals, and a quantization error exists in an encoding process. This quantization error is evenly allocated to the signal of the first sound channel and the signal of the second sound channel. When there is a larger difference between the energy of the signal of the first sound channel and the energy of the signal of the second sound channel of the stereophonic signal, a monophonic quantization error has a greater impact on a channel of signal whose energy is smaller, which reduces the quality of a signal that is generated according to the sideband residual signal.

SUMMARY

Embodiments of the present invention provide a method and an apparatus for generating a sideband residual signal to solve a problem in the prior art that a monophonic quantization error has a greater impact on a channel of signal whose energy is smaller when a quantization error is evenly allocated to a first sound channel and a second sound channel.

An embodiment of the present invention provides a method for generating a sideband residual signal, where the method includes: comparing energy of a first signal input by a first sound channel with energy of a second signal input by a second sound channel; if the energy of the first signal is greater than the energy of the second signal, generating a sideband residual signal by allocating a monophonic quantization error to the first signal; and if the energy of the first signal is smaller than the energy of the second signal, generating a sideband residual signal by allocating a monophonic quantization error to the second signal.

An embodiment of the present invention further provides an apparatus for generating a sideband residual signal, where the apparatus includes: a comparing unit configured to compare energy of a first signal input by a first sound channel with energy of a second signal input by a second sound channel; and a processing unit connected to the comparing unit and configured to: in the case that the comparing unit determines that the energy of the first signal is greater than the energy of the second signal, generate a sideband residual signal by allocating a monophonic quantization error to the first signal; or in the case that the comparing unit determines that the energy of the first signal is smaller than the energy of the second signal, generate a sideband residual signal by allocating a monophonic quantization error to the second signal.

By using the method and apparatus for generating a sideband residual signal according to embodiments of the present invention, the energy of the first signal is compared with the energy of the second signal, and the monophonic quantization error is allocated to a signal whose energy is greater. In this way, it may be avoided that the monophonic quantization error has a greater impact on a signal whose energy is smaller, which improves the quality of a signal whose energy is smaller and is generated according to the sideband residual signal.

BRIEF DESCRIPTION OF THE DRAWINGS

To illustrate the technical solutions in the embodiments of the present invention or in the prior art more clearly, the accompanying drawings required for describing the embodiments or the prior art are briefly introduced in the following. Apparently, the accompanying drawings in the following descriptions merely show some embodiments of the present invention, and persons of ordinary skill in the art may still derive other drawings from these accompanying drawings without creative efforts.

DETAILED DESCRIPTION

To make the objectives, technical solutions, and advantages of the embodiments of the present invention more comprehensible, the technical solutions in the embodiments of the present invention are clearly and completely described in the following with reference to the accompanying drawings in the embodiments of the present invention. Apparently, the embodiments to be described are merely a part rather than all of the embodiments of the present invention. All other embodiments obtained by persons of ordinary skill in the art based on the embodiments of the present invention without creative efforts shall fall within the protection scope of the present invention.

Figure 1:
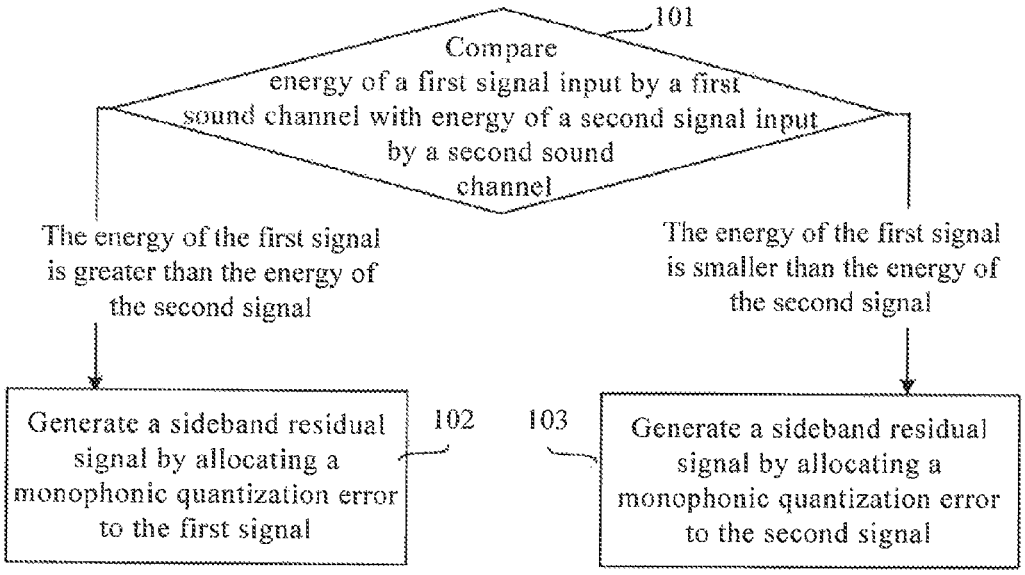
FIG. 1 is a flowchart of a method for generating a sideband residual signal according to a first embodiment of the present invention.

FIG. 1 is a flowchart of a method for generating a sideband residual signal according to a first embodiment of the present invention, where the first embodiment includes:

Step 101: Compare energy of a first signal input by a first sound channel with energy of a second signal input by a second sound channel. If the energy of the first signal is greater than the energy of the second signal, execute step 102, and if the energy of the first signal is smaller than the energy of the second signal, execute step 103.

Step 102: Generate a sideband residual signal by allocating a monophonic quantization error to the first signal.

Step 103: Generate a sideband residual signal by allocating a monophonic quantization error to the second signal.

In FIG. 1, step 102 and step 103 are two branch steps corresponding to two results generated after the judgment is performed in step 101.

By using the method for generating a sideband residual signal according to this embodiment of the present invention, the energy of the first signal is compared with the energy of the second signal, and the monophonic quantization error is allocated to a signal whose energy is greater. In this way, it may be avoided that the monophonic quantization error has a greater impact on a signal whose energy is smaller, which improves the quality of a signal whose energy is smaller and is generated according to the sideband residual signal.

Figure 2:
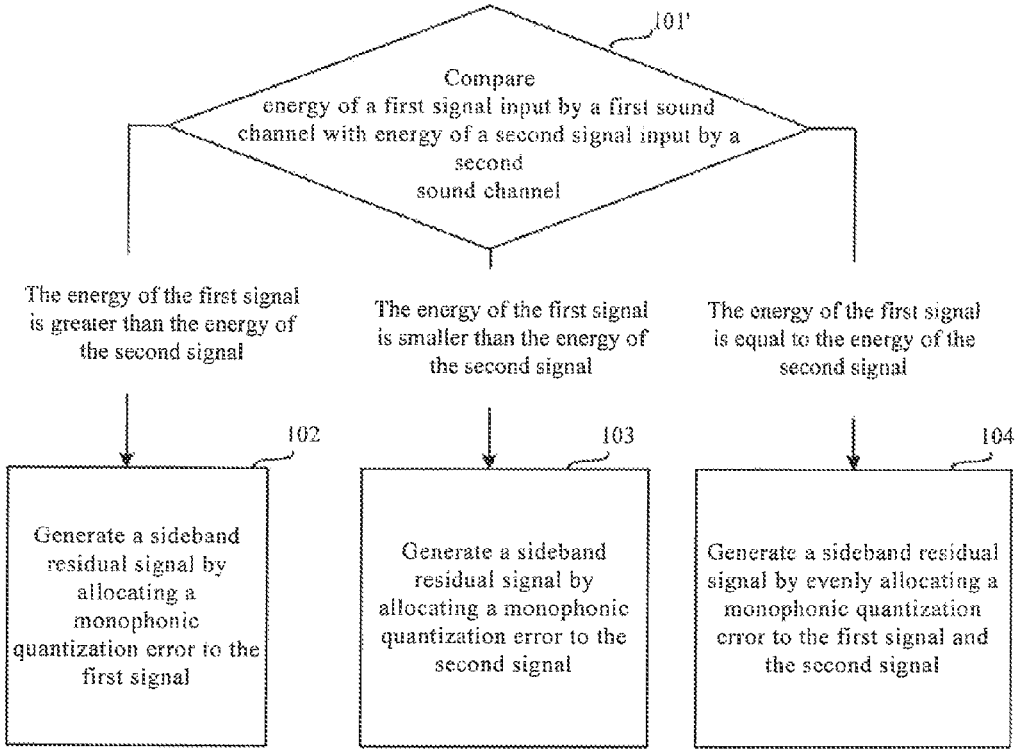
FIG. 2 is a flowchart of a method for generating a sideband residual signal according to a second embodiment of the present invention.

FIG. 2 is a flowchart of a method for generating a sideband residual signal according to a second embodiment of the present invention, where the embodiment includes:

Step 101': Compare energy of a first signal input by a first sound channel with energy of a second signal input by a second sound channel. If the energy of the first signal is greater than the energy of the second signal, execute step 102. If the energy of the first signal is smaller than the energy of the second signal, execute step 103, and if the energy of the first signal is equal to the energy of the second signal, execute step 104.

Step 102: Generate a sideband residual signal by allocating a monophonic quantization error to the first signal.

Step 103: Generate a sideband residual signal by allocating a monophonic quantization error to the second signal.

Step 104: Generate a sideband residual signal by evenly allocating a monophonic quantization error to the first signal and the second signal.

Before step 101 or step 101', a step of obtaining a quantized value CLD_Q of a stereophonic parameter CLD may further be included. Specifically, after the stereophonic parameter CLD is obtained, the CLD is quantized, and the quantized value CLD_Q is obtained. A quantization method may be a scale quantization method or another quantization method.

Step 101 or step 101' may specifically include comparing the CLD_Q with 1. That is, the energy of the first signal may be compared with the energy of the second signal by comparing the CLD_Q with 1. Specifically, if the CLD_Q is greater than 1, the energy of the first signal input by the first sound channel is greater than the energy of the second signal input by the second sound channel. If the CLD_Q is smaller than 1, the energy of the first signal input by the first sound channel is smaller than the energy of the second signal input by the second sound channel, and if the CLD_Q is equal to 1, the energy of the first signal input by the first sound channel is equal to the energy of the second signal input by the second sound channel.

In this embodiment of the present invention, the first signal may be a signal input by a left sound channel, and the first sound channel may be the left sound channel; and the second signal may be a signal input by a right sound channel, and the second sound channel may be the right sound channel. Alternatively, the first signal may be a signal input by a right sound channel, and the first channel may be the right sound channel; and the second signal may be a signal input by a left sound channel, and the second sound channel may be the left sound channel.

Figure 3:
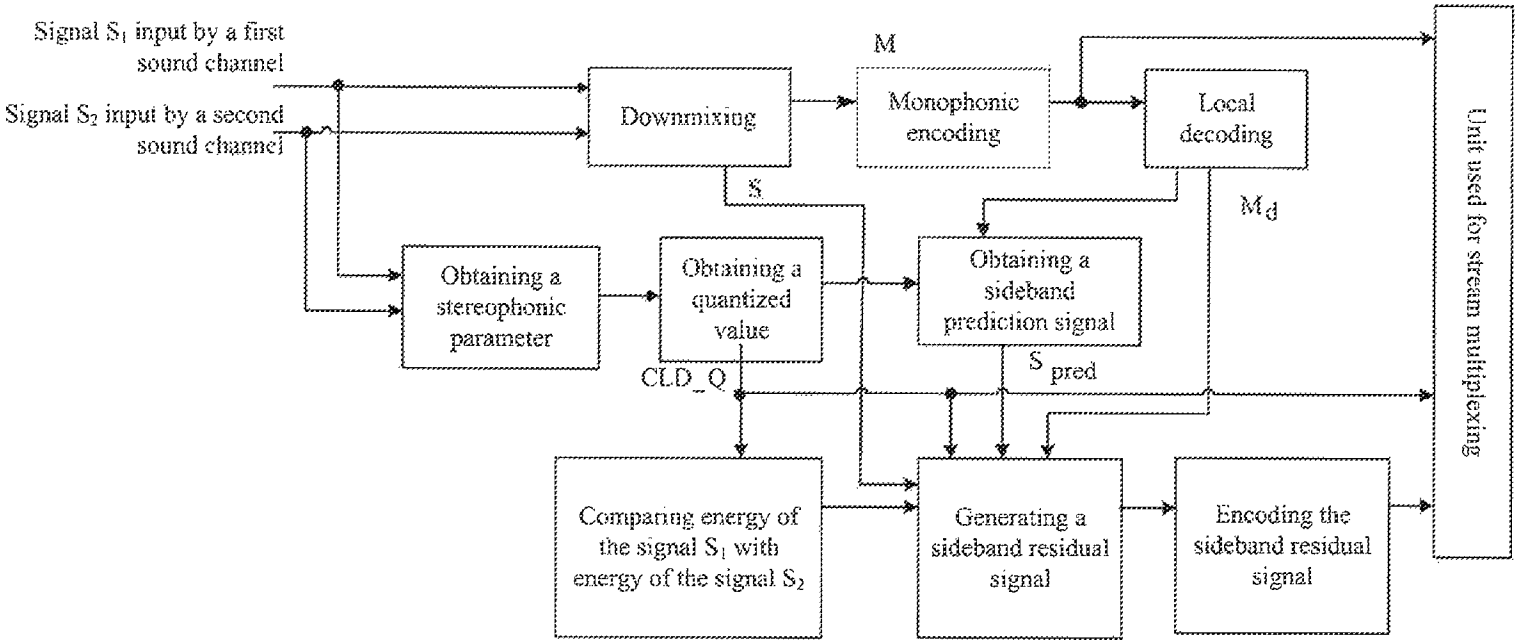
FIG. 3 is a schematic diagram of a principle of a method for generating a sideband residual signal according to the present invention.
Figure 4:
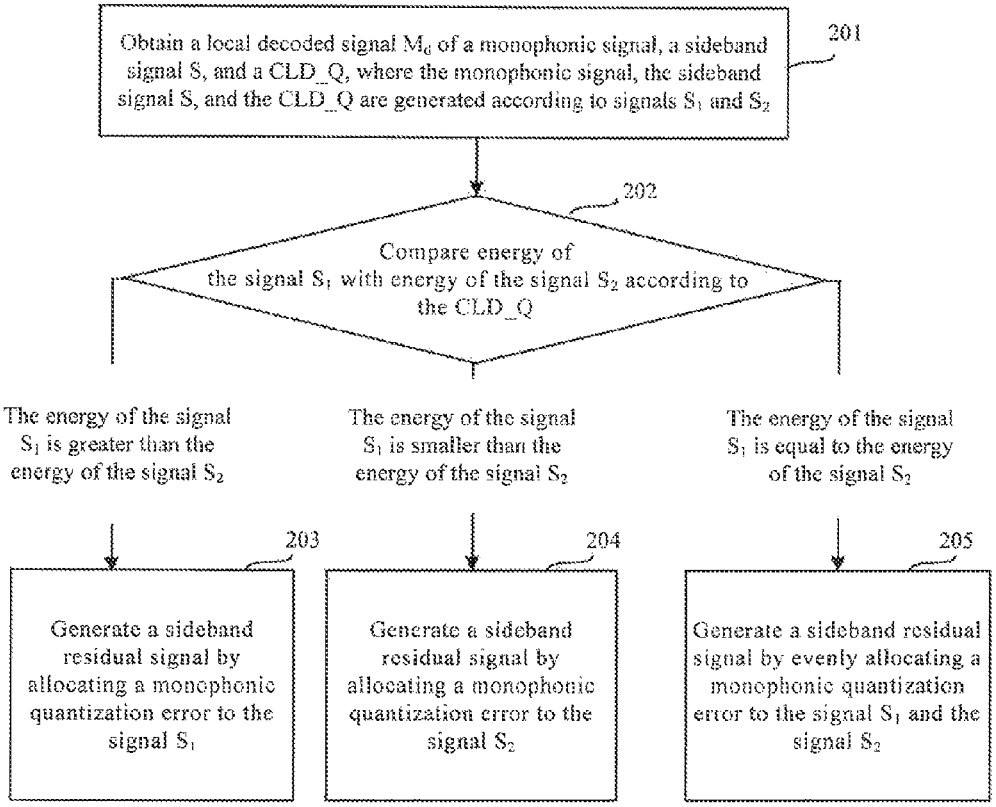
FIG. 4 is a flowchart of a method for generating a sideband residual signal according to a third embodiment of the present invention.

FIG. 3 is a schematic diagram of a principle of a method for generating a sideband residual signal according to the present invention, and FIG. 4 is a flowchart of a method for generating a sideband residual signal according to a third embodiment of the present invention. An implementation process of a method for generating a sideband residual signal according to the present invention is described in the following with reference to FIG. 3 and FIG. 4.

The method provided in the third embodiment of the present invention includes:

Step 201: Obtain a local decoded signal $M_d$ of a monophonic signal, a sideband signal S, and a CLD_Q, where the monophonic signal, the sideband signal S, and the CLD_Q are generated according to signals $S_1$ and $S_2$.

Specifically, the signal $S_1$ input by a first sound channel may be downmixed with the signal $S_2$ input by a second sound channel to obtain a monophonic signal M and a sideband signal S, where $M=(S_1+S_2)/2$ and $S=(S_1-S_2)/2$.

The monophonic signal M is encoded by using a monophonic encoding method, and the encoded signal is decoded to obtain a local decoded signal $M_d$ of the monophonic signal. The monophonic signal may be encoded or decoded based on an encoding and decoding method specified in the G.711.1 or G.722 standard of the ITU Telecommunication Standardization Sector (ITU-T).

A stereophonic parameter CLD is extracted from the signal $S_1$ input by the first sound channel and the signal $S_2$ input by the second sound channel. The signals $S_1$ and $S_2$ are divided into several sub-bands N(band) according to a frequency through time-frequency conversion or by using a sub-band filter. Energy $C_1$ and $C_2$ of each sub-band of the first sound channel and the second sound channel are calculated:

$$C_1(\text{band}) = \sum_{k=N(band)+1}^{k=N(band+1)} (l(k) * l(k)), \text{ and}$$

$$C_2(\text{band}) = \sum_{k=N(band)+1}^{k=N(band+1)} (r(k) * r(k)),$$

where l(k) indicates a value of a signal amplitude of a sub-band of the first sound channel, and r(k) indicates a value of a signal amplitude of a sub-band of the second sound channel. Alternatively, to reduce calculation complicity in time-frequency conversion performed on the signals $S_1$ and $S_2$, the monophonic signal M and the sideband signal S may be used to calculate the energy of each sub-band of the first sound channel and the second sound channel, and then a CLD is obtained. In this way, $$C_1(\text{band}) = \sum_{k=N(band)+1}^{k=N(band)+1} (m(k) + s(k)) * (m(k) + s(k)), \text{ and}$$

$$C_2(\text{band}) = \sum_{k=N(band)+1}^{k=N(band)+1} (m(k) - s(k)) * (m(k) - s(k)),$$

where m(k) indicates a value of a signal amplitude of the monophonic signal M, and s(k) indicates a value of a signal amplitude of the sideband signal S.

The obtained CLD is a ratio of energy of each sub-band of the first sound channel to energy of each sub-band of the second sound channel:

$$CLD(\text{band})=10*\log 10(C_1(\text{band})/C_2(\text{band})).$$

The obtained CLD is quantized as a CLD_Q, and the CLD_Q is transmitted to a decoding end.

A sideband predication signal $S_{pred}$ is generated by using the local decoded signal $M_d$ and the CLD, where $S_{pred}=M_d*(c-1)/(c+1)$, where $c+10^{CLD_Q/20}$.

Step 202: Compare energy of the signal $S_1$ with energy of the signal $S_2$ according to the CLD_Q. If the energy of the signal $S_1$ is greater than the energy of the signal $S_2$, execute step 203. If the energy of the signal $S_1$ is smaller than the energy of the signal $S_2$, execute step 204, and if the energy of the signal $S_1$ is equal to the energy of the signal $S_2$, execute step 205.

Step 203: Generate a sideband residual signal by allocating a monophonic quantization error to the signal $S_1$, where the generated sideband residual signal is $S_{res}=M_d-S_2-M_d*(c-1)/(c+1)$.

Step 204: Generate a sideband residual signal by allocating a monophonic quantization error to the signal $S_2$, where the generated sideband residual signal is $S_{res}=S_1-M_d-M_d*(c-1)/(c+1)$.

Step 205: Generate a sideband residual signal by evenly allocating a monophonic quantization error to the signals $S_1$ and $S_2$, where the generated sideband residual signal is $S_{res}=S-M_d*(c-1)/(c+1)$.

Step 203, step 204, and step 205 are three branch steps corresponding to three results generated after the judgment is performed in step 202.

Through step 201 to step 205, a sideband residual signal is generated. After being encoded, the generated sideband residual signal may also be input with an encoded monophonic signal and the CLD_Q to a unit that is used for stream multiplexing.

In this embodiment of the present invention, the CLD_Q is used to compare the first sound channel with the second sound channel, and an additional bit does not need to be used to transfer comparison information so long as a same operation is performed at the decoding end. In this way, signals decoded at the decoding end are as follows:

When the CLD_Q is greater than 1, $S_{1d}=M_d+(S_{res}+S_{pred})=2M_d-S_2$, and $S_{2d}=M_d-(S_{res}+S_{pred})=S_2$. $S_{2d}$ is irrelevant to $M_d$ and $S_{res}$, while $S_{1d}$ is relevant to $M_d$, that is, the quantization error is allocated to the signal input by the first sound channel.

When the CLD_Q is smaller than 1, $S_{1d}=M_d+(S_{res}+S_{pred})=S_1$, and $S_{2d}=M_d-(S_{res}+S_{pred})=2M_d-S_1$. $S_{1d}$ is irrelevant to $M_d$ and $S_{res}$, while $S_{2d}$ is relevant to $M_d$, that is, the quantization error is allocated to the signal input by the second sound channel.

When the CLD_Q is equal to 1, $S_{1d}=M_d+(S_{res}+S_{pred})=M_d+S$, and $S_{2d}=M_d-(S_{res}+S_{pred})=M_d-S$. $S_{1d}$ is relevant to $M_d$, and $S_{2d}$ is relevant to $M_d$, that is, the quantization error is evenly allocated to the signal input by the first sound channel and the signal input by the second sound channel.

$S_{1d}$ indicates a signal that is decoded and is input by the first sound channel, and $S_{2d}$ indicates a signal that is decoded and is input by the second sound channel.

In step 201, energy of the signal $S_1$ may also be directly compared with energy of the signal $S_2$, without the need of comparing the CLD_Q with 1, to determine the energy of the signal $S_1$ and the energy of the signal $S_2$.

Figure 5:
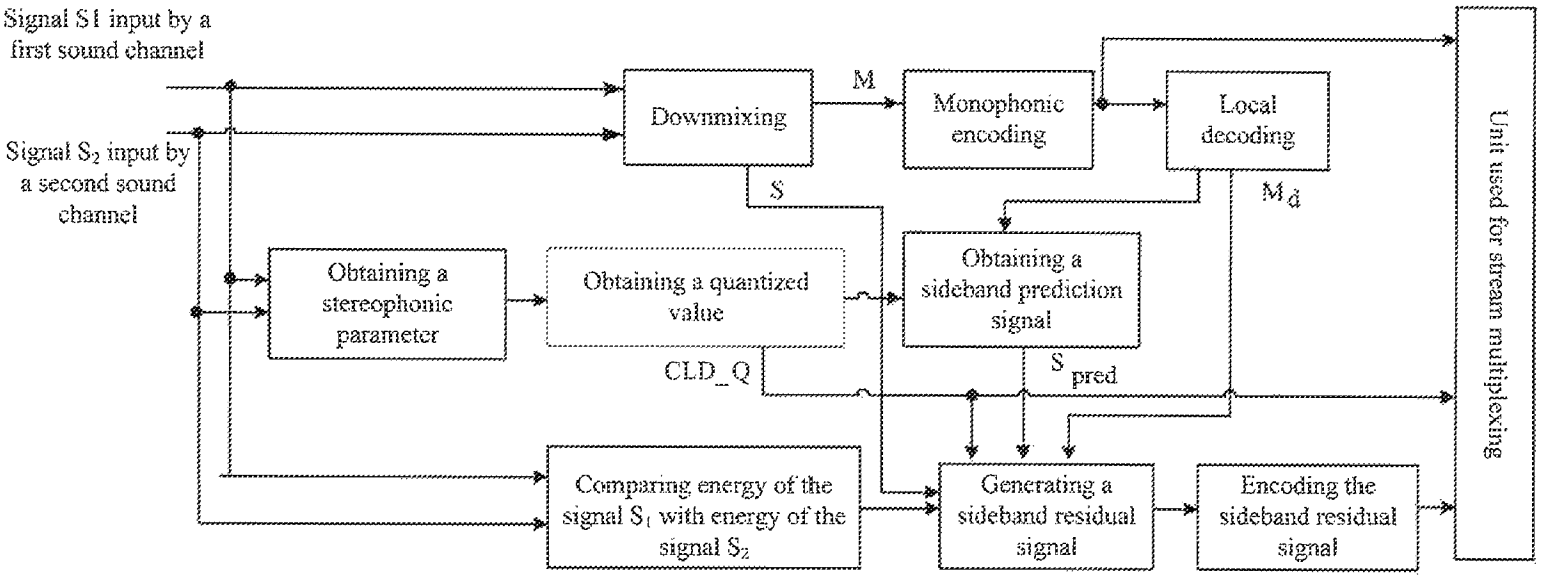
FIG. 5 is another schematic diagram of a principle of a method for generating a sideband residual signal according to the present invention.

FIG. 5 is another schematic diagram of a principle of a method for generating a sideband residual signal according to the present invention. In FIG. 5, energy of a signal $S_1$ input by a first sound channel is directly compared with energy of a signal $S_2$ input by a second sound channel; and a quantization error is allocated to the signal $S_1$ or $S_2$, or a quantization error is evenly allocated to the two signals $S_1$ and $S_2$ according to a comparison result. In this case, signals input by the first sound channel and the second sound channel may be frequency domain signals.

It can be seen from the foregoing embodiments that, when energy of the signal $S_1$ is greater than energy of the signal $S_2$, a monophonic quantization error is allocated to the signal $S_1$. When the energy of the signal $S_1$ is smaller than the energy of the signal $S_2$, the monophonic quantization error is allocated to the signal $S_2$, and when the energy of the signal $S_1$ is equal to the energy of the signal $S_2$, the monophonic quantization error is evenly allocated to the signal $S_1$ and the signal $S_2$. In this way, it can be ensured that a smaller quantization error is introduced for a signal whose energy is smaller, so that the quality of a signal whose energy is smaller and is generated according to a residual signal may be improved.

Figure 6:
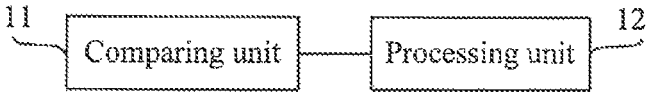
FIG. 6 is a schematic structural diagram of an apparatus for generating a sideband residual signal according to a first embodiment of the present invention.

FIG. 6 is a schematic structural diagram of an apparatus for generating a sideband residual signal according to a first embodiment of the present invention, where the apparatus includes a comparing unit 11 and a processing unit 12. The comparing unit 11 is configured to compare energy of a first signal input by a first sound channel with energy of a second signal input by a second sound channel. The processing unit 12 is connected to the comparing unit 11 and is configured to: in the case that the comparing unit 11 determines that the energy of the first signal is greater than the energy of the second signal, generate a sideband residual signal by allocating a monophonic quantization error to the first signal; or in the case that the comparing unit 11 determines that the energy of the first signal is smaller than the energy of the second signal, generate a sideband residual signal by allocating a monophonic quantization error to the second signal.

In the embodiment shown in FIG. 6, the processing unit 12 may further be configured to: in the case that the comparing unit 11 determines that the energy of the first signal is equal to the energy of the second signal, generate a sideband residual signal by evenly allocating a monophonic quantization error to the first signal and the second signal.

Figure 7:
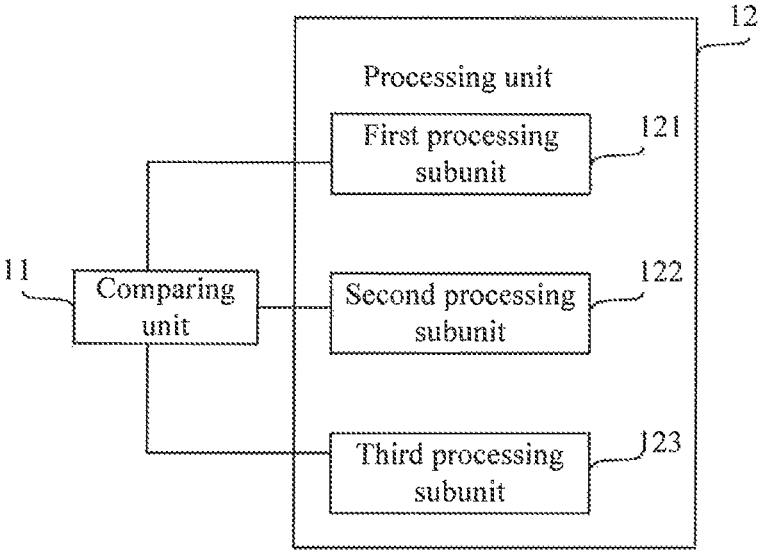
FIG. 7 is a schematic structural diagram of an apparatus for generating a sideband residual signal according to a second embodiment of the present invention.

FIG. 7 is a schematic structural diagram of an apparatus for generating a sideband residual signal according to a second embodiment of the present invention. In this apparatus, a processing unit 12 includes a first processing subunit 121, a second processing subunit 122, and a third processing subunit 123. The first processing subunit 121 is connected to a comparing unit 11 and is configured to: in the case that the comparing unit 11 determines that energy of a first signal $S_1$ is greater than energy of a second signal $S_2$, generate a sideband residual signal by allocating a monophonic quantization error to the first signal $S_1$. The second processing subunit 122 is connected to the comparing unit 11 and is configured to: in the case that the comparing unit 11 determines that the energy of the first signal $S_1$ is smaller than the energy of the second signal $S_2$, generate a sideband residual signal by allocating a monophonic quantization error to the second signal $S_2$. The third processing subunit 123 is connected to the comparing unit 11 and is configured to: in the case that the comparing unit 11 determines that the energy of the first signal $S_1$ is equal to the energy of the second signal $S_2$, generate a sideband residual signal by evenly allocating a monophonic quantization error to the first signal $S_1$ and the second signal $S_2$.

Figure 8:
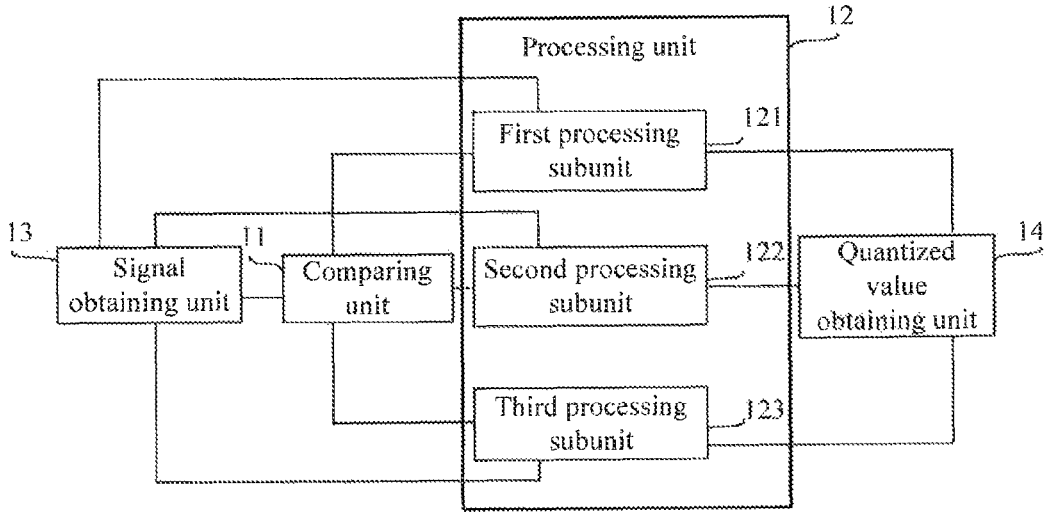
FIG. 8 is a schematic structural diagram of an apparatus for generating a sideband residual signal according to a third embodiment of the present invention.

FIG. 8 is a schematic structural diagram of an apparatus for generating a sideband residual signal according to a third embodiment of the present invention. The apparatus for generating a sideband residual signal further includes a signal obtaining unit 13. The signal obtaining unit 13 is connected to a comparing unit 11, a first processing subunit 121, a second processing subunit 122, and a third processing subunit 123, and the signal obtaining unit 13 is configured to: obtain a first signal $S_1$, a second signal $S_2$, and a sideband signal S, and a local decoded signal $M_d$ of a monophonic signal M that is generated according to the first signal $S_1$ and the second signal $S_2$; and send the signals to the first processing subunit 121, the second processing subunit 122, and the third processing subunit 122 for the three processing subunits to use.

The embodiment shown in FIG. 8 may further include a quantized value obtaining unit 14. The quantized value obtaining unit 14 is connected to the first processing subunit 121, the second processing subunit 122, and the third processing subunit 123. In this embodiment, the first processing subunit 121 is specifically configured to: in the case that the comparing unit 11 determines that energy of the first signal $S_1$ is greater than energy of the second signal $S_2$, generate a sideband residual signal according to a quantized value CLD_Q that is obtained by the quantized value obtaining unit 14, the signals $S_2$ and $M_d$ that are obtained by the signal obtaining unit 13, and a formula $S_{res}=M_d-S_2-M_d*(c-1)/(c+1)$.

The second processing subunit 122 is specifically configured to: in the case that the comparing unit 11 determines that the energy of the first signal $S_1$ is smaller than the energy of the second signal $S_2$, generate a sideband residual signal according to the quantized value CLD_Q that is obtained by the quantized value obtaining unit 14, the signals $S_1$ and $M_d$ that are obtained by the signal obtaining unit 13, and a formula $S_{res}=S_1-M_d-M_d*(c-1)/(c+1)$.

The third processing subunit 123 is specifically configured to: in the case that the comparing unit 11 determines that the energy of the first signal $S_1$ is equal to the energy of the second signal $S_2$, generate a sideband residual signal according to the quantized value CLD_Q that is obtained by the quantized value obtaining unit 14, the signals S and $M_d$ that are obtained by the signal obtaining unit 13, and a formula $S_{res}=S-M_d*(c-1)/(c+1)$.

Figure 9:
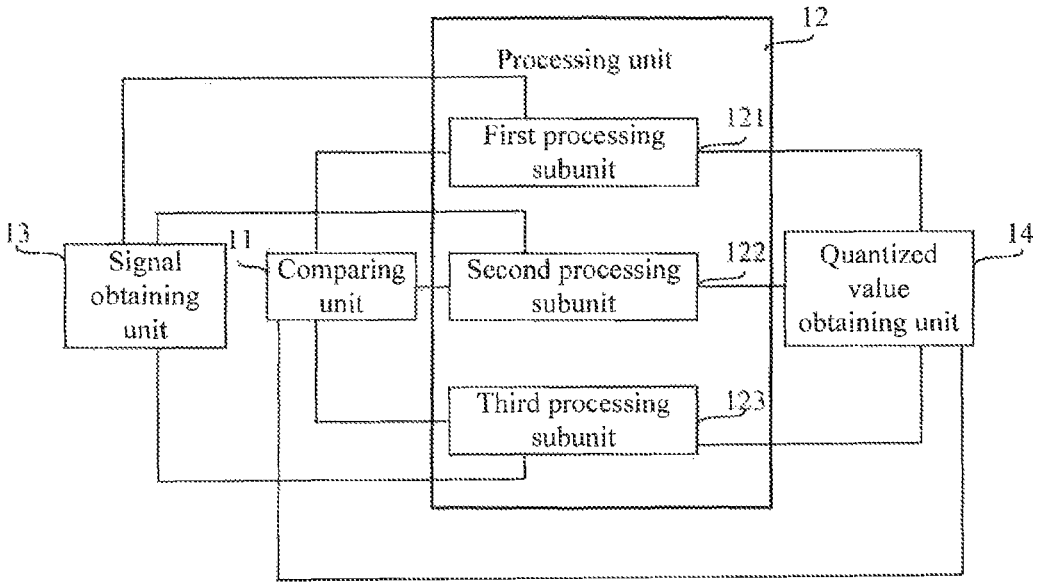
FIG. 9 is a schematic structural diagram of an apparatus for generating a sideband residual signal according to a fourth embodiment of the present invention.

FIG. 9 is a schematic structural diagram of an apparatus for generating a sideband residual signal according to a fourth embodiment of the present invention. This embodiment is different from the embodiment shown in FIG. 8 in that a comparing unit 11 is connected to a quantized value obtaining unit 14 rather than a signal obtaining unit 13. The comparing unit 11 may be specifically configured to: compare a quantized value CLD_Q obtained by the quantized value obtaining unit 14 with 1, where if the CLD_Q is greater than 1, energy of a first signal input by a first sound channel is greater than energy of a second signal input by a second sound channel; where if the CLD_Q is smaller than 1, the energy of the first signal input by the first sound channel is smaller than the energy of the second signal input by the second sound channel; and where if the CLD_Q is equal to 1, the energy of the first signal input by the first sound channel is equal to the energy of the second signal input by the second sound channel.

In FIG. 8, the comparing unit 11 is connected to the signal obtaining unit 13 and may directly compare the energy of the first signal $S_1$ with the energy of the second signal $S_2$, where the first signal $S_1$ and the second signal $S_2$ are obtained by the signal obtaining unit 13. The first processing subunit 121, the second processing subunit 122, and the third processing subunit 123 may generate a corresponding sideband residual signal according to a comparison result of the comparing unit 11.

By using the apparatus for generating a sideband residual signal according to the embodiments of the present invention, the comparing unit compares the energy of the first signal with the energy of the second signal, and the processing unit allocates the monophonic quantization error to a signal whose energy is greater. In this way, it may be avoided that the monophonic quantization error has a greater impact on a signal whose energy is smaller, which improves the quality of a signal whose energy is smaller and is generated according to the sideband residual signal.

Persons of ordinary skill in the art may understand that all or part of the steps of the methods in the embodiments may be implemented by a program instructing relevant hardware. The program may be stored in a computer readable storage medium. When the program is run, the foregoing steps of the methods in the embodiments are performed. The storage medium may be any medium capable of storing program codes, such as ROM, RAM, magnetic disk, or optical disk.

Finally, it should be noted that the foregoing embodiments are merely intended for describing the technical solutions of the present invention rather than limiting the present invention. Although the present invention is described in detail with reference to the foregoing embodiments, persons of ordinary skill in the art should understand that they may still make modifications to the technical solutions described in the foregoing embodiments or make equivalent substitutions to some technical features of the technical solutions, as long as these modifications or substitutions do not cause the essence of corresponding technical solutions to depart from the spirit and scope of the technical solutions in the embodiments of the present invention.

What is claimed is:

1. A method for generating a sideband residual signal comprising:

obtaining a quantized value (CLD_Q) of a stereophonic parameter (CLD);

comparing energy of a first signal input by a first sound channel with energy of a second signal input by a second sound channel by determining whether the CLD_Q is greater than or less than one;

generating the sideband residual signal by allocating a monophonic quantization error to the first signal when the CLD_Q is greater than one and the energy of the first signal is greater than the energy of the second signal; and generating the sideband residual signal by allocating the monophonic quantization error to the second signal when the CLD_Q is less than one and the energy of the first signal is smaller than the energy of the second signal.

2. The method according to claim 1, further comprising:

obtaining a sideband signal S and a local decoded signal $M_d$ of a monophonic signal M that is generated according to the first signal and the second signal;

when the energy of the first signal is greater than the energy of the second signal, generating the sideband residual signal by allocating the monophonic quantization error to the first signal using a formula: $S_{res}=M_d-S_2-M_d*(c-1)/(c+1)$, wherein $S_{res}$ indicates the sideband residual signal, wherein $S_2$ indicates the second signal, and wherein c=(10*CLD_Q)/20; and when the energy of the first signal is smaller than the energy of the second signal, generating the sideband residual signal by allocating the monophonic quantization error to the second signal using a formula: $S_{res}=S_1-M_d-M_d*(c-+1)$, wherein $S_i$ indicates the first signal.

3. An apparatus for generating a sideband residual signal comprising:

a quantized value obtaining unit configured to obtain a quantized value (CLD_Q) of a stereophonic parameter (CLD);

a comparing unit configured to compare energy of a first signal input by a first sound channel with energy of a second signal input by a second sound channel by determining whether the CLD_Q is greater than or less than one; and a processing unit connected to the comparing unit and configured to:

generate the sideband residual signal by allocating a monophonic quantization error to the first signal in the case that the comparing unit determines that the CLD_Q is greater than one and the energy of the first signal is greater than the energy of the second signal; and generate the sideband residual signal by allocating the monophonic quantization error to the second signal in the case that the comparing unit determines that the CLD_Q is less than one and the energy of the first signal is smaller than the energy of the second signal.

4. The apparatus according to claim 3 further comprising a signal obtaining unit configured to obtain a first signal $S_1$, a second signal $S_2$, a sideband signal S, and a local decoded signal $M_d$ of a monophonic signal M that is generated according to the first signal $S_1$ and the second signal $S_2$.

5. The apparatus according to claim 4, wherein the processing unit comprises:

a first processing subunit configured to generate the sideband residual signal when the comparing unit determines that the energy of the first signal $S_i$ is greater than the energy of the second signal $S_2$, wherein the first processing subunit is configured to generate the sideband residual signal according to the CLD_Q that is obtained by the quantized value obtaining unit, the signals $S_2$ and $M_d$ that are obtained by the signal obtaining unit, and a formula $S_{res}=M_d-S_2-M_d*(c-1)/(C+1)$; and a second processing subunit configured to generate the sideband residual signal when the comparing unit determines that the energy of the first signal $S_i$ is smaller than the energy of the second signal $S_2$, wherein the second processing subunit is configured to generate the sideband residual signal according to the CLD_Q that is obtained by the quantized value obtaining unit, the signals $S_1$ and $M_d$ that are obtained by the signal obtaining unit, and a formula $S_{res}=S_1-M_d-M_d*(c-1)/(c+1)$.

6. The method according to claim 1, wherein the CLD_Q is obtained through a scale quantization method.

7. The method according to claim 1, wherein the first sound channel comprises a left sound channel, and the second sound channel comprises a right sound channel.

8. The method according to claim 1, wherein the first sound channel comprises a right sound channel, and the second sound channel comprises a left sound channel.

9. The method according to claim 1, wherein the CLD is extracted from the first signal input by the first sound channel and the second signal input by the second sound channel by dividing sub-bands according to a frequency through time-frequency conversion.

10. The method according to claim 1, wherein the CLD is extracted from the first signal input by the first sound channel and the second signal input by the second sound channel by dividing sub-bands using a sub-band filter.

11. The method according to claim 1, wherein the CLD comprises a ratio of energy of each sub-band of the first sound channel to energy of each sub-band of the second sound channel.

12. The apparatus according to claim 3, wherein the CLD_Q is obtained through a scale quantization method.

13. The apparatus according to claim 3, wherein the first sound channel comprises a left sound channel, and the second sound channel comprises a right sound channel.

14. The apparatus according to claim 3, wherein the first sound channel comprises a right sound channel, and the second sound channel comprises a left sound channel.

15. The apparatus according to claim 3, wherein the CLD is extracted from the first signal input by the first sound channel and the second signal input by the second sound channel by dividing sub-bands according to a frequency through time-frequency conversion.

16. The apparatus according to claim 3, wherein the CLD is extracted from the first signal input by the first sound channel and the second signal input by the second sound channel by dividing sub-bands using a sub-band filter.

17. The apparatus according to claim 3, wherein the CLD comprises a ratio of energy of each sub-band of the first sound channel to energy of each sub-band of the second sound channel.

* * * * *